US006314902B1

(12) United States Patent
Jessen et al.

(10) Patent No.: US 6,314,902 B1
(45) Date of Patent: Nov. 13, 2001

(54) SWIM STEP

(76) Inventors: Robert H. Jessen, 3649 San Jose Ave., #6, Merced, CA (US) 95348; Michael Murphy, 22981 Sierra Trail, Canyon Lake, CA (US) 92587

( * ) Notice: Subject to any disclaimer, the term of this patent is extended or adjusted under 35 U.S.C. 154(b) by 0 days.

(21) Appl. No.: 09/609,631

(22) Filed: Jul. 3, 2000

(51) Int. Cl.[7] ..... B63B 35/40
(52) U.S. Cl. ..... 114/259; 114/362; 114/382
(58) Field of Search ..... 114/362, 365, 114/258, 259, 343, 355, 364, 366, 375, 382; D12/317; 441/72

(56) References Cited

U.S. PATENT DOCUMENTS

| | | | | |
|---|---|---|---|---|
| 2,821,726 | * | 2/1958 | Correll | 114/254 |
| 2,883,684 | * | 4/1959 | Correll | 114/382 |
| 3,613,137 | | 10/1971 | Eccles | 114/362 |
| 3,743,046 | | 5/1973 | Schmidt et al. | 114/259 |
| 4,462,485 | | 7/1984 | Terry et al. | 182/84 |
| 5,170,740 | | 12/1992 | Rottschafer | 114/362 |
| 5,222,454 | | 6/1993 | Meyer | 114/259 |
| 5,715,770 | | 2/1998 | Heyworth | 114/259 |
| 6,089,174 | | 7/2000 | Slikkers et al. | 114/259 |

* cited by examiner

*Primary Examiner*—S. Joseph Morano
*Assistant Examiner*—Andrew Wright
(74) *Attorney, Agent, or Firm*—Joseph E. Mueth

(57) ABSTRACT

The patent describes a power boat having a transom and a swim platform or step generally projecting from the transom at a right angle at or near the water line. The swim step is adapted to the launching of a seated rider carried on a sky ski having an elongated board and a tee bar normally extending from the board into the water. The swim platform has a slot adapted to receive tee bar and extends from the port and/or starboard margins and runs generally parallel to the transom to an extent sufficient to snugly receive the tee bar while the board is supported by the platform with the tee bar extending through the slot and below the platform into the water whereby a rider can mount the seat and secure himself to the sky ski and then readily launch himself and the ski by pushing out of the slot.

8 Claims, 2 Drawing Sheets

FIG. 1.
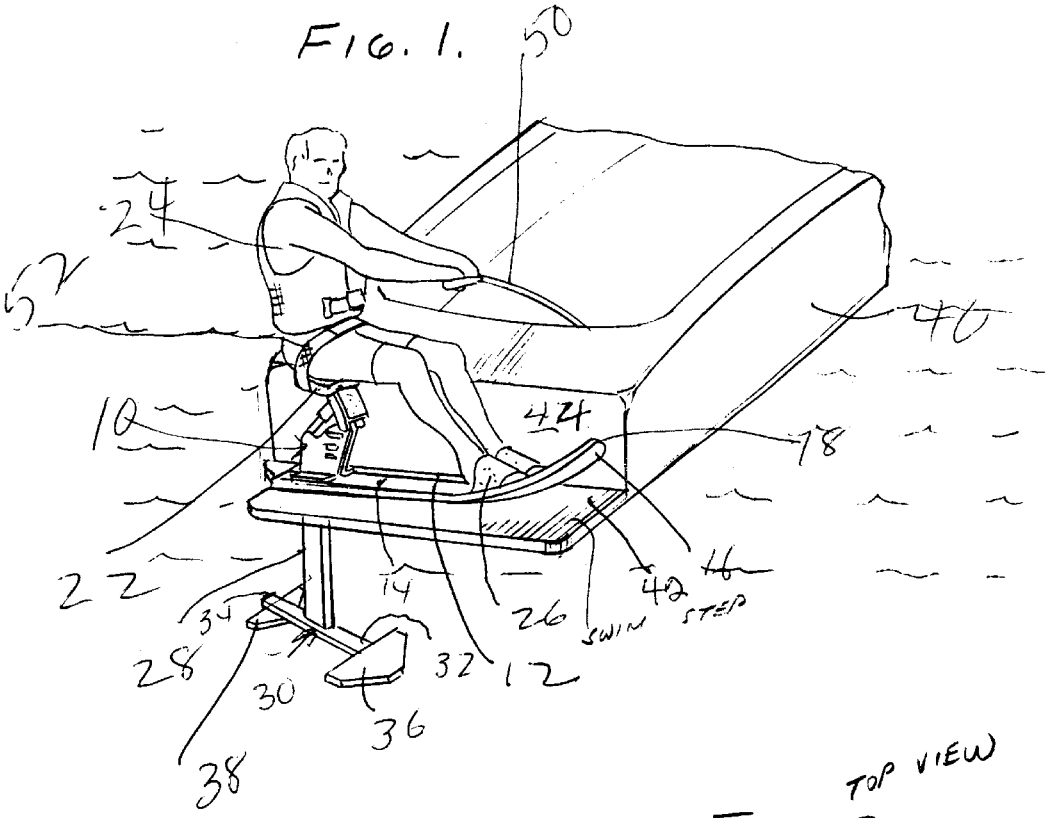
FIG. 2. TOP VIEW
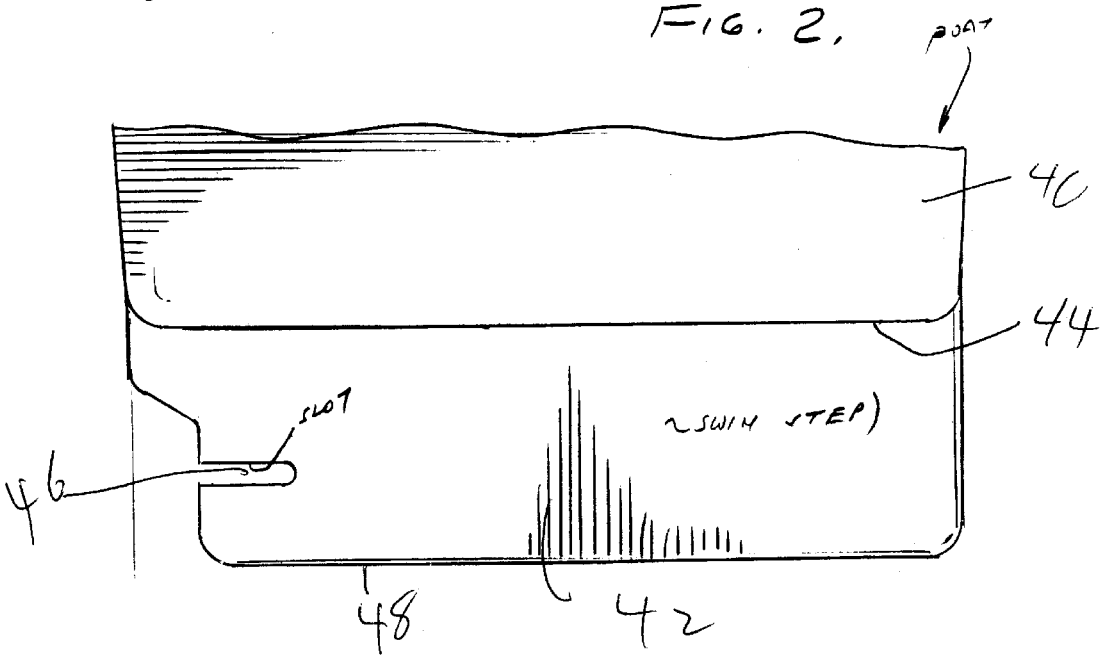

18
42
48
26
SWIM STEP
BOAT
44
12
SLOT
46
16
22
25
10
TEE BAR
20

SWIM STEP

BACKGROUND OF THE INVENTION

Power boats commonly have a swim step or platform which is attached to or formed with the transom. Such steps or platforms extend rearwardly at the waterline from the boat transom. The swim platform facilitates boarding or exiting the boat. It further provides a seating area for swimmers and enables them to easily enter the boat from the water. Swim platforms are also used by water skiers as a staging or launch area.

More recently so-called "sky skis" have been developed. The sky ski is a water sport device for supporting a seated human rider while the rider and the device are towed behind a powered water craft. The sky ski has an elongate board to which a seat and foot holders are secured on the upper surface of the board. An elongate tee bar or strut extends downward from the board and a planing blade is secured to an arm generally parallel to the board so that the planing blade provides essentially no lift when the board is horizontal. The positioning of the seat and the planing blades at the rear of the board, the use of a single vertical tee bar or strut, the size of the planing blade and the positioning of the foot holders in front of the seat provides a water sport device which is relatively easy to ride, while at the same time being highly maneuverable and capable of high jumps while being towed behind a power boat.

An improved sky ski having a shock absorbing tower which supports the seat is disclosed in U.S. patent application Ser. No. 09/453,658 filed Dec. 3, 1999, the disclosure of which is expressly incorporated herein by reference.

SUMMARY OF INVENTION

Briefly, the present invention comprises a power boat having a transom and a swim platform or step generally projecting from the transom at a right angle at or near the water line the improvement wherein the swim step is adapted to the launching of a seated rider carried on a sky ski having an elongated board and a tee bar normally extending from the board into the water, said swim platform having a slot adapted to receive said tee bar and extending from the port and/or starboard margins and running generally parallel to the transom to an extent sufficient to snugly receive the tee bar while said board is supported by the platform with the tee bar extending downwardly through the slot and below the platform into the water whereby a rider can mount the seat and secure himself to the sky ski and then readily launch himself and the ski by pushing out of the slot while the rider holds onto a tow rope.

The invention also comprehends the method of launching a sky ski from the swim platform of a power boat having a transom and swim platform extending substantially across the transom at about the waterline which comprises providing a slot extending from the port and/or starboard margins of the swim platform and running generally parallel to the transom, providing a sky ski including an elongated board having upper and lower surfaces with a seat carried on the upper surface of said board and spaced above the board, a tee bar extending below the board, said tee bar being snugly received in said slot with the lower surface of said board resting on the swim platform positioning and receiving a rider on said seat, the rider manually grasping a tow rope near one end with the other end being affixed to the boat, and the rider pushing himself and the board off of the swim platform and the tee bar out of said slot while continuing to hold onto the tow rope while the bot is underway.

The combination of a power boat having a transom with a swim platform across the transom, a notch or slot in the starboard and/or port margin of said swim platform; and a sky ski including an elongate board, a seat carried by said board above the upper surface of the board, a tee bar extending downwardly below the lower surface of said board, said lower surface of the board resting on said swim platform with said tee bar being snugly being received in said slot.

THE DRAWINGS

Turning to the drawings:

FIG. 1 is a perspective view of a sky ski with rider in the launch position on the swim step or platform of this invention.

FIG. 2 is a top view of a power boat provided with novel swim step or platform.

DESCRIPTION OF THE PREFERRED EMBODIMENTS

Figure 3:
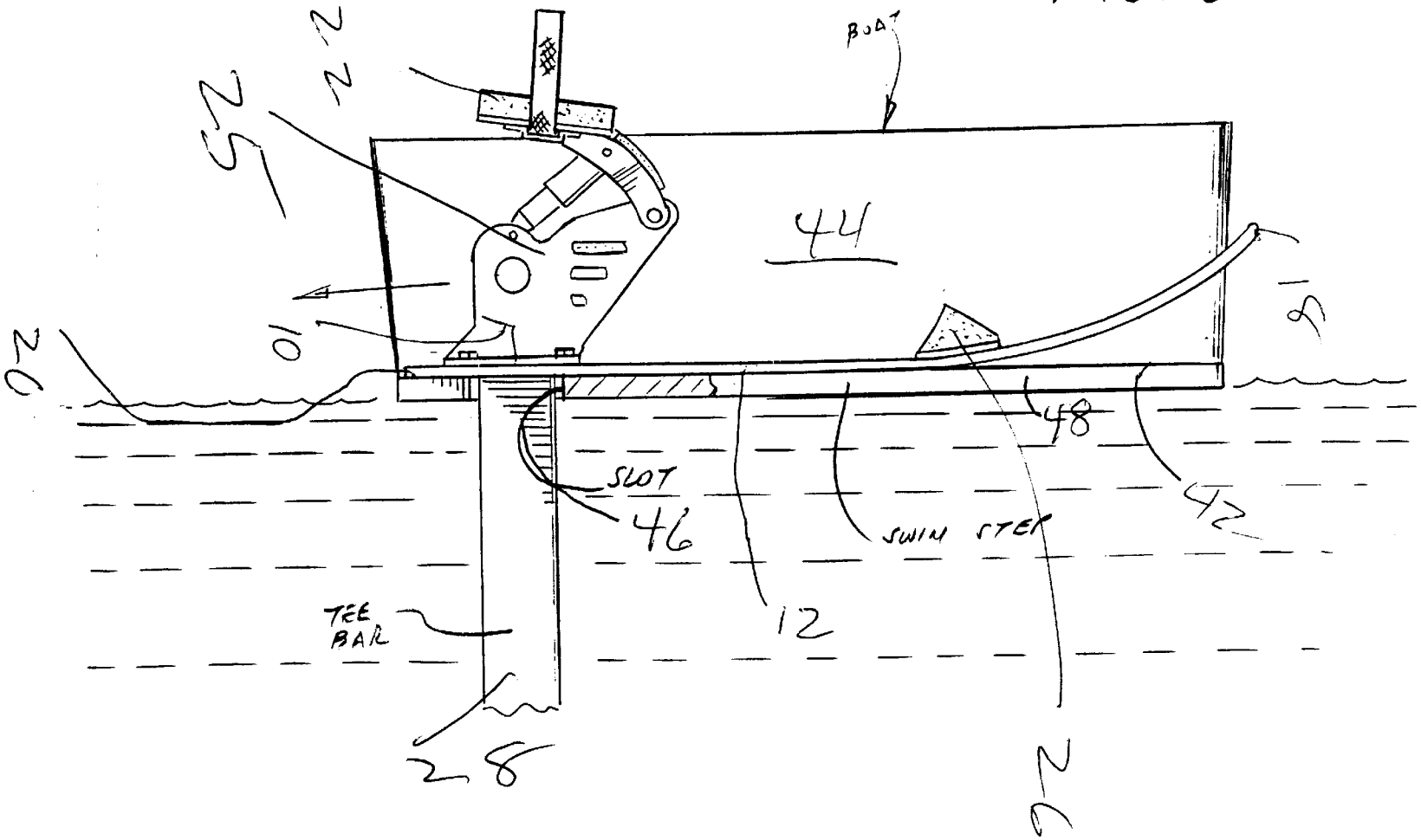
FIG. 3 is a rear view showing the sky ski as it is received in the notch in the novel swim step or platform.

Referring to the Figures, there is shown a "flying ski" or "sky ski" 10 which embodies the preferred design of the water sports device of the present invention. The flying ski 10 includes an elongate board 12 having an upper face 14 and a lower face 16, and a front end 18 and a back end 20. A seat 22 extends generally perpendicular to and upward from the upper face 14 of the board for supporting the buttocks of a seated rider 24 at a point spaced above the back of the board. The seat is supported by and connects to the board 12 via a shock absorbing tower 25 which is adapted to maintain the leading edge of the seat 22 at a fixed distance from the board 12 while otherwise allowing the seat carrying a rider to controllably move up and down in response to the impact of the board on the water while it is being towed and thereby cushion the effect of impact on the rider. Further detail regarding the shock tower and seat is provided in the copending patent application referred herein above. The rider's legs extend forward toward the front of the board, where they are secured by a pair of rubber loops 26. An elongate tee bar or strut 28 extends generally perpendicular to and downward from the lower face 16 of the board 12. An elongate support 30 having a forward end 32 and rearward end 34 is fixed to the bottom end of the tee bar or strut 28 at a point just forward of the middle of the support 30. A forward planing blade 36 is secured to the top of the forward end 32 of the support 30 so as to be generally parallel to the board 12. Likewise, a rear planing blade 38 is secured to the bottom of the rearward end 34 of the support 30 generally parallel to the board. The planing blade structure (i.e., the tee bar or strut 28, the support 30, the forward planing blade 36 and, the rear planing blade 38) provide essentially no lift when the board 12 is horizontal.

The power boat 40 is of generally known configuration except for the novel swim platform or step 42 which projects a right angle from the transom 44 at a point which normally is just above the water line. The novel swim platform has a slot or notch 46 extending from one of the lateral portions of the swim platform 42. The notch 46 extends in a direction generally parallel to the transom 44 and the trailing edge 48 of swim platform. Normally, a notch is provided on only one side of the swim platform. However, a notch can be provided on both port and starboard margins. The notch 46 is sized so as to snugly receive the tee bar 28 while the lower face 16 of elongate board 12 rests on the swim platform 42.

The sky ski 10 and rider are towed behind the powered water craft of this invention utilizing a standard ski tow rope 50, the handle of which is held by the rider (as illustrated in FIG. 1). The rider is normally secured to the seat 22 by a seat belt 52 with his feet in the rubber loops 26.

In use, the sky ski can be placed onto the swim platform 42 with the tee bar 28 in notch 46 prior to the boat getting underway, as shown in FIG. 3. Once underway, the rider can mount seat 22 and fasten seat belt 52. The notch and tee bar form a snug sliding fit which prevents the sky ski moving on the platform and causing damage to the transom. This arrangement also provides a safe way in which the rider can mount the sky ski.

Once the rider is secured, launch can be accomplished simply by the rider grasping the handle on tow rope 50 and pushing (or being pushed) laterally off of the swim platform 42 and out of notch 46. The forward directional movement of the boat as transmitted to the rider by the tow rope will then right the sky ski and align the rider behind the boat in a towing position ready for jumps and flying.

The following claims form part of this patent.

We claim:

1. A power boat having a transom and a swim platform or step generally projecting from the transom at a right angle at or near the water line an improvement wherein the swim platform is adapted to the launching of a seated rider carried on a sky ski comprising an elongated board, a seat for a rider carried above said board, and a bar normally extending from the board into the water, said swim platform being adapted to support said elongated board and having a slot being adapted to receive said bar and extending from the port and/or starboard margins and running generally parallel to the transom to an extent sufficient to snugly receive the bar while the elongated board is supported by the platform with the bar extending downwardly through the slot and below the platform into the water.

2. The power boat of claim 1 wherein the swim platform has a single slot extending from one of said margins.

3. A swim step adapted to be carried across the transom of a power boat and adapted to the launching of a seated rider carried on a sky ski comprising an elongated board, a seat for a rider carried above said board, and a bar normally extending from the board into the water, said swim step being adopted to support said elongated board and having a slot adapted to receive said bar and extending from the port and/or starboard margins and running generally parallel to the transom to an extent sufficient to snugly receive the bar while said board is supported by the swim step with the bar extending downwardly through the slot and below the platform into the water.

4. The swim step of claim 3 wherein the swim platform has a single slot extending from one of said margins.

5. The combination of a power boat having a transom with a swim platform across the transom, a notch or slot in the starboard and/or port margin of said swim platform; and a sky ski including an elongate board, a seat carried by said board above the upper surface of the board, a tee bar extending downwardly below the lower surface of said board, said lower surface of the board resting on said swim platform with said tee bar being snugly received in said slot.

6. The combination of claim 5 wherein the swim platform has a single slot extending from one of said margins.

7. The method of launching a sky ski from the swim platform of a power boat having a transom and swim platform extending substantially across the transom at about the waterline which comprises providing a slot extending from the port and/or starboard margins of the swim platform and running generally parallel to the transom, providing a sky ski including an elongated board having upper and lower surfaces with a seat carried on the upper surface of said board and spaced above the board, a tee bar extending below the board, said tee bar being snugly received in said slot with the lower surface of said board resting on the swim platform positioning and receiving a rider on said seat, the rider manually grasping a tow rope near one end with the other end being affixed to the boat, and the rider pushing himself and the board off of the swim platform and the tee bar out of said slot while continuing to hold onto the tow rope while the boat is underway.

8. The method of claim 7 wherein the swim platform has a single slot extending from one of said margins.

* * * * *